US007748705B2

(12) United States Patent
Yamada

(10) Patent No.: US 7,748,705 B2
(45) Date of Patent: Jul. 6, 2010

(54) PAPER DISCHARGE TRAY

(75) Inventor: Masayuki Yamada, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 846 days.

(21) Appl. No.: 11/167,223

(22) Filed: Jun. 28, 2005

(65) Prior Publication Data

US 2006/0017219 A1 Jan. 26, 2006

(30) Foreign Application Priority Data

Jul. 13, 2004 (JP) ..... 2004-205372

(51) Int. Cl.
*B65H 31/00* (2006.01)

(52) U.S. Cl. ..... 271/209; 271/211; 271/213; 271/223; 271/224; 399/405; 347/104

(58) Field of Classification Search ..... 271/220, 271/224, 209, 211, 213, 223, 3.02, 3.03, 271/207; 347/104; 399/405
See application file for complete search history.

(56) References Cited

U.S. PATENT DOCUMENTS 5,111,252 A * 5/1992 Hamada et al. ..... 399/393
5,280,897 A * 1/1994 Maekawa ..... 271/3.03
5,377,966 A * 1/1995 Ohmori ..... 271/4.01
5,397,119 A * 3/1995 Brewster et al. ..... 271/171
5,534,989 A * 7/1996 Rubscha et al. ..... 399/381
5,984,299 A * 11/1999 Hirota et al. ..... 271/161
6,065,747 A * 5/2000 Khovaylo et al. ..... 271/209
6,095,516 A * 8/2000 Sawano et al. ..... 271/207
6,145,834 A * 11/2000 Hirota et al. ..... 271/225
6,601,842 B2 * 8/2003 Kobayashi et al. ..... 271/3.14
6,612,560 B2 * 9/2003 Sanders ..... 270/58.12
6,953,192 B2 * 10/2005 Jang ..... 271/213
7,016,629 B2 * 3/2006 Ishii et al. ..... 399/258
7,099,618 B2 * 8/2006 Iwago et al. ..... 399/367

(Continued)

FOREIGN PATENT DOCUMENTS

JP 57-166262 10/1982

(Continued)

OTHER PUBLICATIONS

Chinese Office Action corresponding to Chinese Patent Application No. 2005100835986.

*Primary Examiner*—Patrick Mackey
*Assistant Examiner*—Prasad V Gokhale
(74) *Attorney, Agent, or Firm*—Smith, Gambrell & Russell, LLP

(57) ABSTRACT

A paper discharge tray 6 includes: a paper loading portion 7 provided in a bent form including a first tray surface 7*a* and a second tray surface 7*b*; a rear wall 8 for supporting and aligning the trailing end of paper discharged on the paper loading portion 7; and an installation portion 10 provided along the paper loading portion 7. On two portions of the first tray surface 7*a*, there are provided guide members 11 each having a first slope 11*a* that inclines upward in the paper discharge direction (direction indicated by an arrow A in the figure). When paper of a predetermined size is discharged on the guide members 11, the paper slides down along the first slopes 11*a* and the second tray surface 7*c*, and then is loaded with the trailing end of the paper aligned by the rear wall 8.

17 Claims, 7 Drawing Sheets

U.S. PATENT DOCUMENTS

| | | | | |
|---|---|---|---|---|
| 7,246,963 | B2 * | 7/2007 | Nishimura | 400/692 |
| 7,263,327 | B2 * | 8/2007 | Nagayama | 399/405 |
| 7,339,654 | B2 * | 3/2008 | Mizubata et al. | 355/407 |
| 7,395,026 | B2 * | 7/2008 | Seo et al. | 399/405 |
| 7,484,729 | B2 * | 2/2009 | Ono et al. | 271/209 |
| 7,547,015 | B2 * | 6/2009 | Lee et al. | 271/213 |
| 2004/0062579 | A1 | 4/2004 | Iwago et al. | |
| 2005/0047842 | A1 * | 3/2005 | Nobe | 399/405 |
| 2006/0018693 | A1 * | 1/2006 | Nobe et al. | 399/405 |
| 2006/0044543 | A1 * | 3/2006 | Mizubata et al. | 355/407 |
| 2006/0051147 | A1 * | 3/2006 | Sato et al. | 399/405 |

FOREIGN PATENT DOCUMENTS

| | | |
|---|---|---|
| JP | 05-097313 | 4/1993 |
| JP | 7-61683 | 3/1995 |
| JP | 2004-035214 | 2/2004 |

* cited by examiner

PAPER DISCHARGE TRAY

This application is based on Japanese Patent Application No. 2004-205372 filed on Jul. 13, 2004, the contents of which are hereby incorporated by reference.

BACKGROUND OF THE INVENTION

1. Field of the Invention

The present invention relates to a paper discharge tray that is mounted in an image forming apparatus, such as a copier; printer, or facsimile, and holds paper discharged.

2. Description of Related Art

An image forming apparatus, such as a copier or laser printer, is provided with a paper discharge tray for discharging: already processed paper having a desired image formed thereon by an electrophotographic process; or a document whose image has been read after conveyed to a document reading portion by a document conveying device. FIG. 6 is a schematic cross section showing the structure of a conventional paper discharge tray to be used as a discharge destination of already processed paper having an image formed thereon. In FIG. 6, a paper discharge roller 1 is rotated by a motor, not shown, in a direction indicated by an arrow A. Then through a discharge outlet 5, the paper discharge roller 1 discharges, in a direction indicated by an arrow B, paper 4 conveyed through a paper conveyance path 3 together with a paper discharge roller 2 which is driven into rotation by being brought in contact with the paper discharge roller 1 with a predetermined pressure.

The paper 4 discharged is sequentially loaded onto the paper discharge tray 6. The paper discharge tray 6 includes: a paper loading portion 7 having a first tray surface 7*a* for receiving the substantially front portion of paper discharged and a second tray surface 7*b* for receiving the substantially rear portion of paper discharged arranged in a bending manner; a rear wall 8 for holding and aligning the trailing end of paper; and a front wall 9 for holding the leading end of paper to prevent the paper from dropping off from the paper loading portion 7. To ensure a certain paper stack amount, there is provided a height difference h between the discharge outlet 5 and the paper loading portion 7 of the paper discharge tray 6.

The paper loading portion 7 is generally so arranged as to incline upward in the paper discharge direction (direction indicated by the arrow B in the figure) so that the paper 4 discharged through the discharge outlet 5 will not drop off from the paper loading portion 7. In this embodiment, the second tray surface 7*b* is so arranged as to incline upward more steeply than the first tray surface 7*a* so that the paper loading portion 7 is bent into a substantially inverted-V shape. Thus, paper discharged is loaded along the bending direction, thereby absorbing the curling tendency (upward curling) of the discharged paper. The inverted-V-shaped bending form controls the bulk height of the paper discharge tray 6 and also contributes to space saving at a time of loading the paper discharge tray 6 in an image forming apparatus.

In such a paper discharge tray, in accordance with paper size within a predetermined size, the height difference h provided for ensuring the paper stack amount and also the slope of the paper loading portion 7 are both fixed at predetermined dimension and predetermined orientation. This permits loading and then stocking paper of a predetermined size or a size nearly equal to the predetermined size without any problems. Therefore, when the height difference h is larger than the paper size, for example, the leading end portion of the paper 4 discharged through the discharge outlet 5 droops so largely as to come into substantially vertical contact with the paper loading portion 7, as shown in FIG. 7A. Further discharge of the trailing end portion of the paper 4 in this state results in a risk that the paper 4 is inverted, as shown in FIG. 7B. On the other hand, a smaller height difference h results in a failure to ensure a sufficient paper stack amount.

A smaller height difference h results in smaller upward inclination of the second tray surface 7*b* in the paper discharge direction. Therefore, depending on the paper discharge speed, the leading end of the paper 4 protrudes toward the first tray surface 7*a* side beyond the bending portion. Since the inclination of the first tray surface 7*a* is more moderate than that of the second tray surface 7*b*, the friction between loaded paper sheets prevents the paper 4 from slipping down to the rear wall 8, thereby leading to a disturbance in the loading condition, particularly when the paper 4 is discharged continuously. This phenomenon becomes more outstanding with an increase in the number of paper discharged. The description has been given here, referring to a paper discharge tray to be used as a discharge destination of paper having an image already formed thereon. However, the description is also similarly applicable to a paper discharge tray to be used as a discharge destination of a document automatically conveyed by the document conveying device.

Various methods have been proposed which properly load paper of different sizes on a discharge tray while ensuring a sufficient paper stack amount. For example, Japanese Patent Application Laid-open NO. H5-97313 (hereinafter referred to as patent document 1) discloses a paper discharge tray capable of loading paper on appropriate position regardless of the size and stiffness of the paper by providing a mountain-like guide that is movable in the paper discharge direction. Moreover, Japanese Patent Application Laid-open No. 2004-35214 (hereinafter referred to as patent document 2) discloses a paper discharge tray including a paper discharge board and a movable loading board. The paper discharge tray disclosed in the patent document 2 adjusts the height difference from the paper discharge outlet to the paper discharge board by transferring the movable loading board in the paper discharge direction in accordance with the paper size, thereby ensuring the paper stack amount in accordance with the paper size.

However, the method disclosed in the patent document 1 is not intended to ensure the paper stack amount. Thus, this method can load paper of various types properly on their respective predetermined positions regardless of the sizes and hardness of the paper, but fails to provide a sufficient paper stack amount. The method disclosed in the patent document 2 requires the entire paper discharge tray to be moved in accordance with the paper size, thus resulting in complicated structure of the paper discharge tray and cumbersome operation to be performed by the user.

SUMMARY OF THE INVENTION

Considering the problems described above, it is an object of the present invention to provide a paper discharge tray capable of properly loading discharged paper on appropriate position and providing a satisfactory paper stack amount.

To achieve the object described above, according to one aspect of the present invention, a paper discharge tray including: a first tray surface that receives the substantially front portion of paper discharged; a second tray surface that receives the substantially rear portion of paper discharged; a paper loading portion provided in a bent form by arranging the first and second tray surfaces so that both the first and second tray surfaces incline upward in a paper discharge direction with the second tray surface steeper than the first tray surface, wherein paper discharged is loaded along the bent form; and a rear wall that supports the trailing end of paper loaded on the paper loading portion. There is provided on the first tray surface at least one guide member having a first sloping part that inclines upward in the paper discharge direction with respect to the first tray surface and at least partially more steeply than the second tray surface.

According to this configuration, paper sized smaller than the second tray surface slides down along the second tray surface whereas paper sized larger than the second tray surface is first discharged on the guide member and then reliably slides down along the first sloping part steeper than the second tray surface, before both types of the paper are aligned by the rear wall. Therefore, the loading condition does not become disturbed by the frictional force between paper sheets even in a case of discharging paper continuously. Further, the height difference provided in the paper loading portion can be increased to ensure a sufficient paper stack amount.

In the paper discharge tray of the present invention, the first sloping part inclines more steeply as the first sloping part approaches closer to the top of the guide member.

According to this configuration, a space is formed between paper discharged on the guide member and the first sloping part. This avoids close contact between the paper and the first sloping part, thereby making it easier for the paper to slide down.

In the paper discharge tray of the present invention, the guide member is provided closer to the second tray surface than the leading end portion of paper loaded in a manner protruding from the second tray surface in the discharge direction.

According to this configuration, paper sized larger than the second tray surface is always discharged on the guide member, thereby providing even more reliable slide-down effect offered by the guide member.

In the paper discharge tray of the present invention, an uppermost part of the first sloping part is located on a plane extended from the second tray surface in the paper discharge direction.

According to this configuration, when paper sized larger than the second tray surface is discharged on the guide member, the paper surface forms the same inclination as that of the second tray surface, thereby permitting paper sequentially loaded to reliably slide down to the rear wall along paper loaded previously.

In the paper discharge tray of the present invention, the guide member is movable in the paper discharge direction with respect to the first tray surface.

This configuration permits small adjustment of the position of the guide member in accordance with the paper size, thus permitting even more stable paper loading.

In the paper discharge tray of the present invention, the dimension of the guide member in the width direction orthogonal to the paper discharge direction is four times larger than the average thickness of the paper loading portion.

This configuration permits easy molding of the guide member and also permits enhancing the strength.

In the paper discharge tray of the present invention, there is formed, on a more downstream side of the first tray surface in the paper discharge direction than the guide member, a drop-off prevention stopper that is selectively arranged at a first position or a second position. The first position supports the leading end of paper loaded in a manner protruding from the paper loading portion so as to prevent the paper from dropping off. The second position lifts the leading end of paper stored on the paper loading portion beyond the guide member so as to permit easy alignment of the paper by the rear wall.

According to this configuration, the arrangement of the drop-off prevention stopper at the first position permits paper sized larger than the paper loading portion to be loaded without dropping off, and the arrangement of the drop-off prevention stopper at the second position permits preventing the bending of the leading end of paper so sized as to go beyond the guide member to thereby stably load the paper on the paper loading portion.

In the paper discharge tray of the present invention, the drop-off prevention stopper is supported on the end portion of the first tray surface in the paper discharge direction so as to be turnable up and down. When the drop-off prevention stopper is arranged at the second position on the first tray surface, one surface of the drop-off prevention stopper forms a second sloping part that inclines upward in the paper discharge direction and more steeply than the first tray surface. When the drop-off prevention stopper is arranged at the first position by being turned in such a direction as to separate from the first tray surface, another surface of the drop-off prevention stopper forms a front wall that supports the leading end of the paper loaded in a manner protruding from the paper loading portion.

According to this configuration, the arrangement of the drop-off prevention stopper can easily be switched between the first and second positions. Moreover, since one surface of the drop-off prevention stopper forms the second sloping part steeper than the first sloping part when the drop-off prevention stopper is arranged at the second position, paper loaded on the second sloping part more effectively slides down to the rear wall. Since another surface of the drop-off prevention stopper forms the front wall that supports the leading end of the paper when the drop-off prevention stopper is arranged at the first position, the effect of paper drop-off prevention becomes reliable.

In the paper discharge tray of the present invention, the top of the drop-off prevention stopper arranged at the second position is located on a plane that passes through the top of the guide member and also is substantially parallel to the first tray surface.

According to this configuration, when paper is loaded onto the drop-off prevention stopper beyond the guide member, the paper surface between the guide member and the drop-off prevention stopper forms substantially the same inclination as that of the first tray surface, thereby permitting paper sequentially loaded to reliably slide down to the rear wall along the surface of paper previously loaded.

DETAILED DESCRIPTION OF PREFERRED EMBODIMENTS

Figure 1:
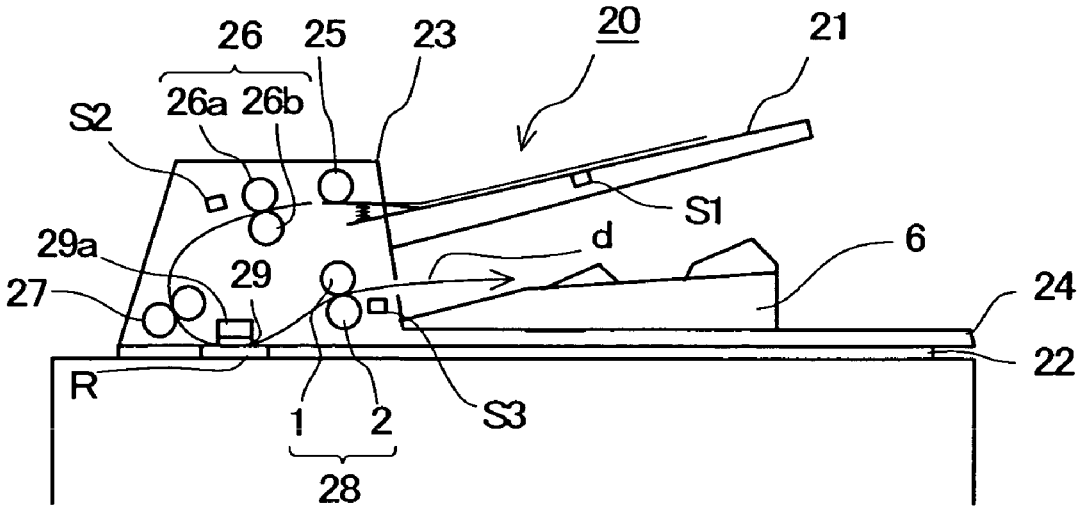
FIG. 1 is a schematic view showing the structure of a document conveying device to which a paper discharge tray of the present invention is fitted.

The embodiment of the present invention will be described below with reference to the accompanying drawings. FIG. 1 is a schematic view showing the overall structure of a document conveying device provided with a paper discharge tray of the present invention. As shown in FIG. 1, the document conveying device 20 roughly includes: a document feed tray 21 on which documents to be supplied are loaded; a document cover 23 which is located above an image-reading position R on a document loading board 22 and which is provided with the document feed tray 21 in a protruding manner; and a paper discharge tray 6 which is directly fitted to the partial top surface of a document holder 24 beside the document cover 23. A document conveyance path d is formed, extending from the document feed tray 21 to the paper discharge tray 6 through the inside of the document cover 23.

In the document cover 23, there are provided: in the order from the upstream side along the document conveyance path d, a pickup roller 25, a conveyance roller pair 26, a registration roller pair 27, and a discharge roller pair 28. Of these rollers, the conveyance roller pair 26 includes a drive roller 26*a* and a separation roller 26*b*. The separation roller 26*b* rotates in the direction opposite to the rotational direction of the drive roller 26*a* only when the rotation load is equal to or smaller than a predetermined torque, and is driven to rotate with the drive roller 26*a* when the rotation load is larger than the predetermined torque.

The discharge roller pair 28 includes a discharge roller 1 and a paper discharge roller 2 that is driven to rotate with the discharge roller 1. The paper discharge roller 2 is so supported as to be rotatable toward the paper discharge tray 6. Between the registration roller pair 27 and the discharge roller pair 28, there are provided: a white reference plate 29 for shading correction which faces the image-reading position R on the document loading board 22; and a document pressing portion 29*a* that is located behind the white reference plate 29 and presses the white reference plate 29 toward the image-reading position R. The document conveyance path d is so curved as to be reversed between the conveyance roller pair 26 and the image-reading position R.

In the document conveyance path d, there are provided at respective appropriate positions a plurality of sensors for detecting the presence/absence of a document. For example, there are provided: a document detection sensor S1 at the central portion of the document feed tray 21; a paper feed sensor S2 in the downstream side of the conveyance roller pair 26; and a discharge sensor S3 in the downstream side of the discharge roller pair 28.

Figure 2:
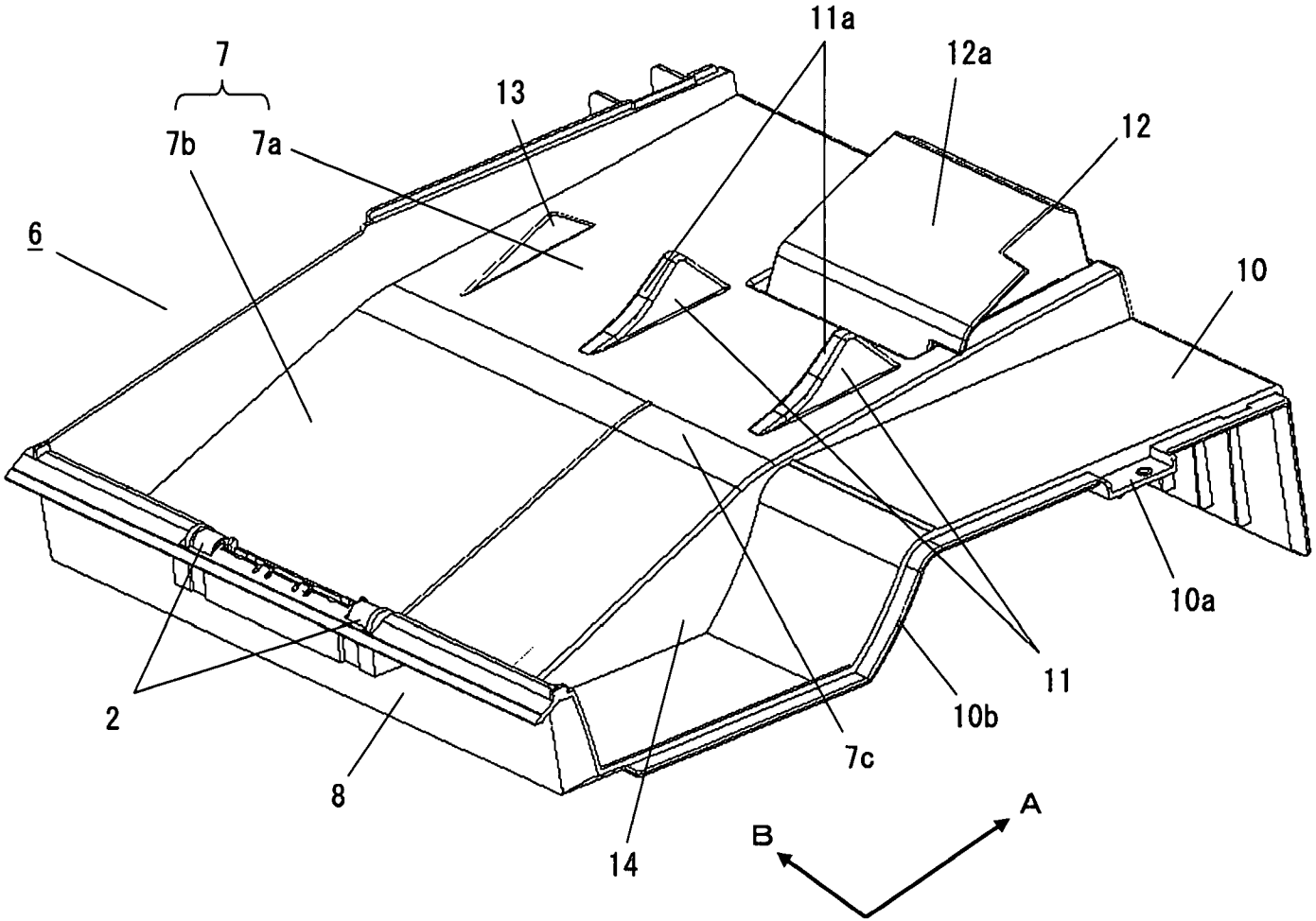
FIG. 2 is a perspective view showing the overall structure of the paper discharge tray of the invention.
Figure 6:
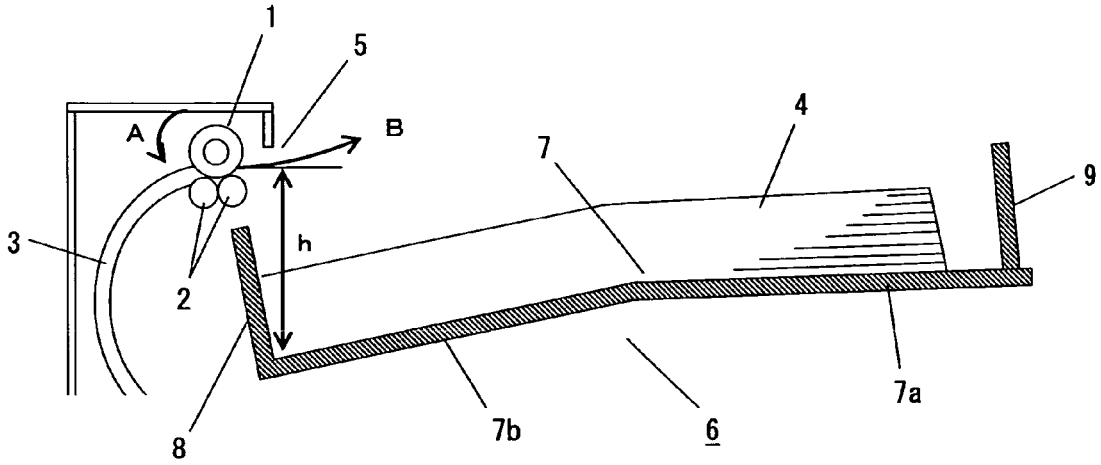
FIG. 6 is a cross section showing the structure of a conventional paper discharge tray.
Figure 7A:
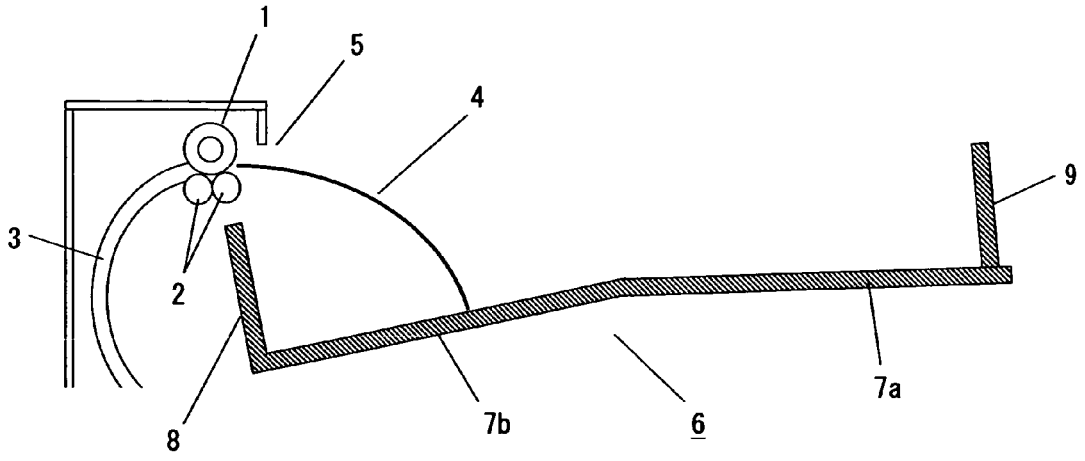
FIG. 7 is a cross section showing the state in which paper is discharged on the conventional paper discharge tray.
Figure 7B:
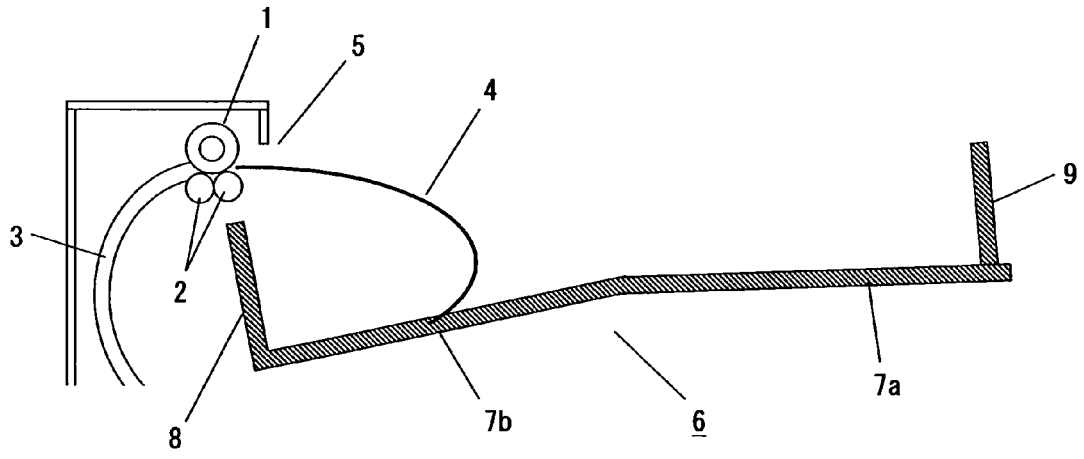

Next, description will be given on the structure of the paper discharge tray of the present invention. FIG. 2 is a perspective view showing the overall structure of the paper discharge tray. Portions equivalent to those shown in the conventional example of FIG. 6 are provided with the same numerals, and therefore are omitted from the detailed description. In FIG. 2, the paper discharge tray 6 includes: a paper loading portion 7 provided in a bent form which includes a first tray surface 7*a* and a second tray surface 7*b*; a rear wall 8 which supports and aligns the trailing end of paper discharged on the paper loading portion 7; and an installation portion 10 which is provided along the paper loading portion 7. On the upper center of the rear wall 8, there are arranged paper discharge rollers 2 that are driven into rotation with a discharge roller (see FIG. 1) while being brought into contact with the discharge roller by a predetermined pressure.

On two portions of the first tray surface 7*a*, there are provided guide members 11 each having a first sloping part 11*a* that inclines upward in the paper discharge direction (direction indicated by an arrow A in the figure). When paper of a predetermined size is discharged from an discharge outlet 5 (not shown) onto the guide members 11, the paper slides down along the first sloping parts 11*a* and the second tray surface 7*b*, and then is loaded with the trailing end of the paper supported by the rear wall 8.

Even when, by force of paper discharge, the leading end of the paper protrudes toward the first tray surface 7*a* beyond the bending portion 7*c* of the paper loading portion 7, after the leading end of the paper is lifted by the guide members 11, the paper can reliably slide down to the rear wall 8 along the first sloping parts 11*a* and then be loaded with the trailing end of the paper aligned by the rear wall 8. Further, even in a case of discharging paper continuously, each paper sheet can be slid down against friction, thereby eliminating a risk of disturbance in the loading condition. In this embodiment, the guide members 11 are provided on the two portions. The number of guide members 11, however, can be set in accordance with the specifications of the paper discharge tray 6 or paper size.

Figure 3:
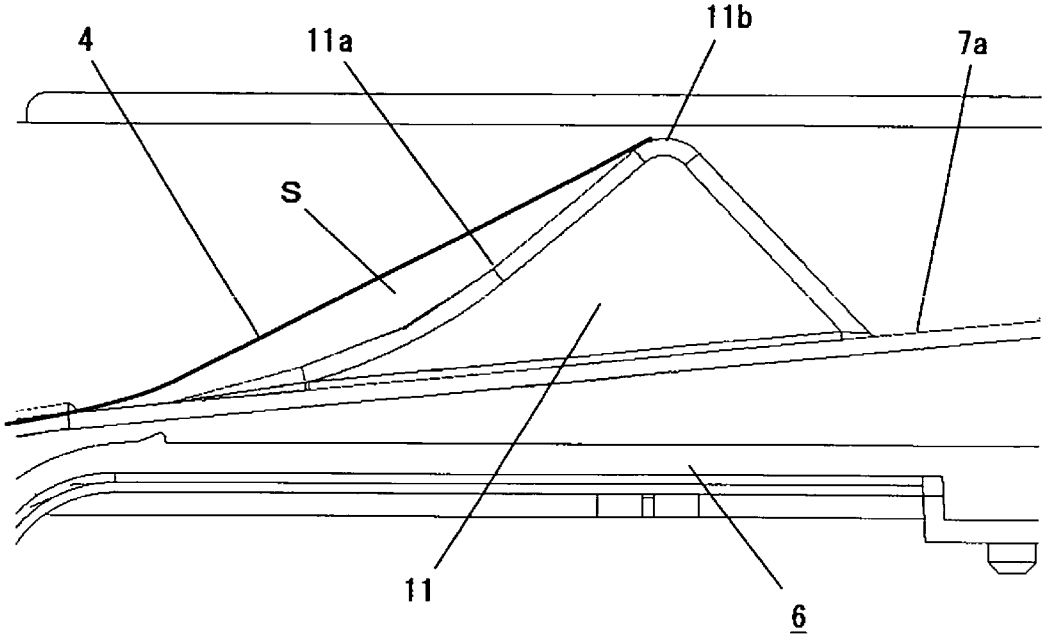
FIG. 3 is an enlarged side view of a guide member.

FIG. 3 is an enlarged side view of the guide member 11. As shown in FIG. 3, the first sloping part 11 a inclines more steeply as it approaches closer to a top 11*b* of the guide member 11. This structure provides a space S between the rear surface of paper 4 discharged on the guide member 11 and the first sloping part 11*a*, thereby reducing the contact area therebetween. That is, the paper 4 and the first sloping part 11*a* do not come into close contact with each other, thereby permitting reducing the frictional force. This makes it easier for the paper 4 to slide down toward the rear wall 8 (see FIG. 2).

Referring back to FIG. 2, the position of the guide members 11 in the discharge direction (direction indicated by the arrow A) is set such that the leading end of paper sized between B5R and A4 can smoothly slide down along the first sloping parts 11*a*. The position of the guide members 11 in the direction (direction indicated by an arrow B) orthogonal to the discharge direction is set in the width range of paper slid down by the guide members 11. However, the positions where the guide members 11 are provided are not limited to the position described above, but can be set in accordance with the size of paper slid down by the guide members 11, the paper discharge speed, or the like.

The guide members 11 may be molded separately from the paper loading portion 7 and then fixed onto the first tray surface 7*a* at assembly. Alternatively, the guide members 11 may be molded integrally with the paper loading portion 7. Although no limitation is provided for the thickness of the guide members 11, it is more preferable, when the guide members 11 are molded integrally, that the thickness of the guide members 11 be more than four times as large as the average thickness of the paper loading portion 7, because such a limitation permits suppressing burr generation and the like and also permits ensuring the strength of the guide members 11. Furthermore, for the purpose of improving the effect of sliding down the paper by the guide members 11, the guide members 11 may be formed with fluorinated resin, or the first sloping parts 11*a* may be coated with fluorinated resin.

On a more downstream side in the discharge direction (direction indicated by the arrow A) than the guide members 11, there is provided a drop-off prevention stopper 12 that prevents the drop-off of paper of such a large size that the paper is loaded with the leading end portion thereof beyond the paper loading portion 7. The drop-off prevention stopper 12 is turnably supported on the end portion of the first tray surface 7*a* in the discharge direction, so that the drop-off prevention stopper 12 can be selectively arranged at a position that prevents the drop-off of paper loaded in a manner protruding from the paper loading portion 7 (hereinafter referred to as a first position), or at a position that supports the leading end of paper stored on the paper loading portion 7 beyond the guide members 11 (hereinafter referred to as a second position). FIG. 2 shows the drop-off prevention stopper 12 arranged at the second position.

The drop-off prevention stopper 12 arranged at the second position forms a second sloping part 12*a* that inclines more steeply than the first tray surface 7*a*. Accordingly, even when paper longer than the length between the rear wall 8 and the guide members 11 is discharged on the paper loading portion 7, the leading end of the paper slides down along the second sloping part 12*a*, the guide members 11, and the second tray surface 7*b*, and then the paper is loaded on the appropriate position with the trailing end of the paper aligned by the rear wall 8.

Since the leading end of paper loaded beyond the guide members 11 is lifted by the drop-off prevention stopper 12, even in the case of discharging paper continuously, each paper sheet can be slid down against the frictional force, and further the leading end of the paper loaded beyond the guide members 11 can be prevented from hanging downward, thus inhibiting downward curl. Numeral 13 is a curl preventing projection that prevents downward curl caused by paper of a large size hanging downward in the paper width direction when loaded on the guide members 11. The height of the curl preventing projection 13 is designed to be equal to or slightly smaller than the height of the guide members 11.

Near the center of the installation portion 10, there is provided a screw hole 10*a* for screw-fixing the paper discharge tray 6 on the document holder 24 (see FIG. 1). There is provided a riser 10*b* from the bending portion 7*c* toward the second tray surface 7*b*. This riser 10*b* forms a cut 14 that permits a finger to be inserted below paper loaded on the paper loading portion 7, thus permitting easy removal of the paper loaded on the paper loading portion 7.

Figure 4:
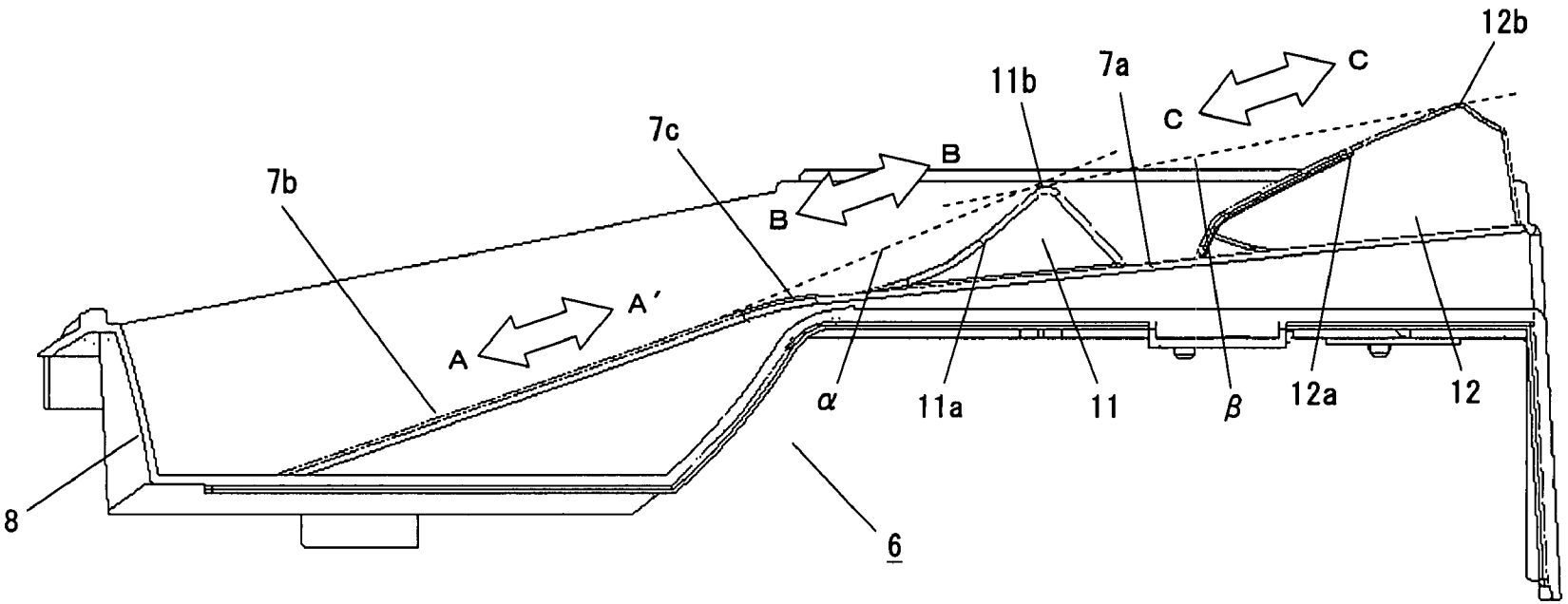
FIG. 4 is a side cross section of the paper discharge tray, showing a drop-off prevention stopper located at a second position.
Figure 5:
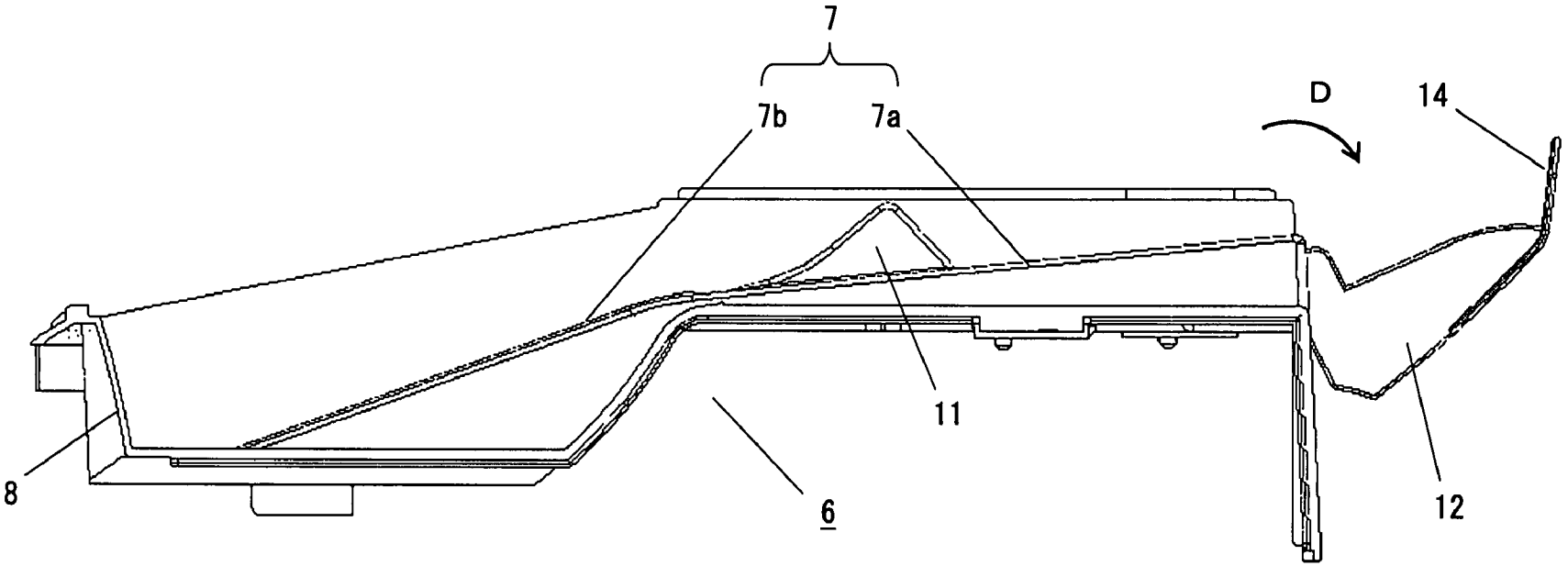
FIG. 5 is a side cross section of the paper discharge tray, showing the drop-off prevention stopper located at a first position.

FIGS. 4 and 5 are side cross sections of the paper discharge tray 6 as viewed from the direction indicated by the arrow B of FIG. 2. Portions common to those shown in FIG. 2 are provided with the same numerals, and thus are omitted from the detailed description. FIG. 4 shows the drop-off prevention stopper 12 located at the second position. FIG. 5 shows the drop-off prevention stopper 12 located at the first position. Referring to FIGS. 4 and 5, description will be given on the mechanism in which paper of different sizes is smoothly loaded onto the paper discharge tray 6.

First, description will be given on cases where the paper size is equal to or smaller than B4, with reference to FIG. 4. When the paper size is smaller than A5R, paper never protrudes toward the first tray surface 7*a* beyond the bending portion 7*c*. Therefore, the paper moves up and down along the slanting second tray surface 7*b* in the direction indicated by an arrow A-A', and then is loaded with the trailing end portion of the paper aligned by the rear wall 8. When the paper size is between B5R and A4, the leading end portion of paper protrudes toward the first tray surface 7*a* beyond the bending portion 7*c*. Therefore, the paper moves up and down along the sloping parts 11*a* of the guide members 11 and the slanting second tray surface 7*b* in the direction indicated by an arrow B-B', and then is loaded with the trailing end portion of the paper aligned by the rear wall 8.

The top 11*b* of the guide member 11 is so designed to be located on a plane a extended from the paper-loading surface of the second tray surface 7*b*. Accordingly, the surface of paper loaded on the guide members 11 has the same inclination as that of the second tray surface 7*b*. In the case of discharging paper continuously, therefore, paper sequentially located can smoothly and reliably slide down to the rear wall along the inclination of the surface of paper loaded previously.

When the paper size is B4, the leading end portion of paper protrudes further beyond the guide members 11 in the discharge direction. Therefore, the paper moves up and down along the second sloping part 12*a* of the drop-off prevention stopper 12 arranged at the second position, the first shapes sloping parts 11*a* of the guide members 11, and the slanting second tray surface 7*b* in the direction indicated by an arrow C-C' in the figure, and then is loaded with the trailing end portion of the paper aligned by the rear wall 8.

In this embodiment, a top 12*b* of the drop-off prevention stopper 12 is so designed as to be located on a plane β which passes through the tops 11*b* of the guide members 11 and which is substantially parallel to the paper loading surface of the first tray surface 7*a*. Accordingly, the surface of the paper loaded on the guide members 11 and the drop-off prevention stopper 12 have substantially the same inclination as that of the first tray surface 7*a*. In the case of discharging paper continuously, therefore, paper sequentially loaded can smoothly and reliably slide down to the rear wall along the inclination of the surface of paper loaded previously, as is the case with paper sizes of B5R to A4.

Next, description will be given on a case where the paper size is equal to or larger than A3, with reference to FIG. 5. Paper sized A3 or larger protrudes outward from the paper loading portion 7 beyond the end portion of the first tray surface 7*a*, which leads to the necessity of preventing loaded paper from dropping off. Thus, the drop-off prevention stopper 12 is turned in the direction indicated by an arrow D so as to be transferred from the second position (see FIG. 4) to be arranged at the first position. To the edge of the drop-off prevention stopper 12, there is provided a tongue piece 14, which forms a front wall of the paper loading portion 7 when arranged at the first position and supports the leading end portion of loaded paper to thereby prevent the paper from dropping off from the paper loading portion 7.

This permits paper sized A3 or larger to be reliably loaded without dropping off from the paper loading portion 7. When the drop-off prevention stopper 12 is arranged at the second position (see FIG. 4), the tongue piece 14 is inserted in an insertion opening (not shown) formed in the first tray surface 7*a*.

When paper sized A3 or larger is not discharged, the drop-off prevention stopper 12 is not necessarily required. For example, when paper to be discharged is sized A4 or smaller, only the guide members 11 shown in FIGS. 2 to 6 are sufficiently satisfactory. When paper to be discharged is sized B4 or smaller, the paper can be smoothly loaded by providing, instead of the drop-off prevention stopper 12, a guide member 11 having a first sloping part 11*a* whose height is equal to that of the drop-off prevention stopper 12 at the second position and whose inclination is equal to that of the second sloping part 12*a*.

The aforementioned embodiment has been described, referring only to the case where the guide members 11 are fixed on the first tray surface 7*a*. However, the guide members 11 may be movable on the first tray surface 7*a* in the paper discharge direction. This permits the minor adjustment of the position of the guide members 11 in accordance with the size of paper to be discharged, thus permitting even more stable paper loading.

The embodiment described above is an example of a preferable paper discharge tray for use in the present invention, and the curl preventing projection 13, the cut 14, and the like are not necessarily required. The present invention is not limited to the embodiment described above, but various modifications are permitted without departing from the theme of the present invention. For example, the aforementioned embodiment has been described, referring to, as an example, the paper discharge tray to be used for loading documents discharged form the document conveying device 20. The embodiment is also applicable to a paper discharge tray to be used as a discharge destination of paper to be subjected to image forming processing.

According to the present invention, paper sized smaller than the second tray surface slides down along the inclination of the second tray surface, and paper sized larger than the second tray surface is discharged on the guide members and then smoothly slides down along the first sloping parts that are steeper than the second tray surface. Therefore, this permits, even in the case of discharging paper continuously, providing a paper discharge tray capable of loading paper on appropriate position while ensuring a sufficient paper stack amount.

The first sloping parts incline more steeply as they approach closer to the tops of the guide members. Thus, the space between paper discharged on the guide members and the first sloping parts reduces the frictional force, thus permitting the paper to slide down more smoothly. Moreover, providing guide members that are located closer to the second tray surface than the leading end of paper loaded in a manner protruding from the second tray surface permits paper sized larger than the second tray surface to be always discharged on the guide members, further ensuring the slide-down effect.

The tops of the guide members are located on the extension plane of the second tray surface. Thus, when paper sized larger than the second tray surface is loaded on the guide members, the paper surface formed has the same inclination as that of the second tray surface, so that paper sequentially loaded reliably slides down to the rear wall along the paper loaded previously. The width of the guide member is four times larger than the average thickness of the paper loading portion, thereby making it easier to mold the guide members integrally with the paper loading portion and also improving the strength. Further, the guide members are movable in the paper discharge direction, thereby permitting the position adjustment of the guide members in accordance with the paper size.

On the more downstream side in the discharge direction than the guide members, the drop-off prevention stopper is arranged selectively at the first position that prevents the drop off of paper loaded in a manner protruding from the paper loading portion, or at the second position that lifts the leading end of paper stored on the paper loading portion beyond the guide members so as to facilitate the alignment of paper by the rear wall. Consequently, the arrangement of the drop-off prevention stopper at the first position permits paper sized larger than the paper loading portion to be loaded without dropping off, and the arrangement of the drop-off prevention stopper at the second position permits preventing the bending of the leading end portion of paper loaded in a manner protruding from the guide members.

Moreover, the drop-off prevention stopper is supported on the end portion of the first tray surface so as to be turnable up and down. One surface of the drop-off prevention stopper forms, when arranged at the second position, the second sloping part inclining more steeply than the first tray surface. The other surface of the drop-off prevention stopper forms, when arranged at the first position, a front wall that supports the front end of paper. Therefore, the turning of the drop-off prevention stopper permits easily switching the arrangement, the second sloping part permits the paper to be even more stably loaded and slide down to the rear wall, and the front wall permits even more reliably preventing the paper from dropping off.

As a result of locating the top of the drop-off prevention stopper arranged at the second position such that the top of the drop-off prevention stopper passes through the tops of the guide members and is also on a plane substantially parallel to the first tray surface, paper loaded on the drop-off prevention stopper beyond the guide members forms a surface having the same inclination as that of the first tray surface, thus permitting paper sequentially loaded to reliably slide down to the rear wall along the surface of paper previously loaded.

What is claimed is:

1. A paper discharge tray comprising:

a first tray surface that receives a substantially front portion of paper discharged;

a second tray surface that receives a substantially rear portion of paper discharged;

a paper loading portion provided in a bent form by arranging the first and second tray surfaces so that both the first and second tray surfaces incline upward in a paper discharge direction with the second tray surface steeper than the first tray surface, wherein paper discharged is loaded along the bent form; and a rear wall that supports a trailing end of paper loaded on the paper loading portion, wherein there is provided on the first tray surface and between a bending portion of the first and second tray surfaces and an end portion of the first tray surface, at least one guide member having a first sloping part that inclines upward in the paper discharge direction with respect to the first tray surface and inclines more steeply than the second tray surface, and wherein the first sloping part inclines more steeply as the first sloping part approaches closer to a top of the guide member.

2. The paper discharge tray of claim 1, wherein the guide member is provided closer to the second tray surface than a leading end portion of paper loaded in a manner protruding from the second tray surface in the discharge direction.

3. The paper discharge tray of claim 2, wherein there is formed, on a more downstream side of the first tray surface in the paper discharge direction than the guide member, a drop-off prevention stopper that is selectively arranged at a first position or a second position, the first position supporting a leading end of paper loaded in a manner protruding from the paper loading portion so as to prevent the paper from dropping off, the second position lifting a leading end of paper stored on the paper loading portion beyond the guide member so as to permit easy alignment of the paper by the rear wall.

4. The paper discharge tray of claim 3, wherein the drop-off prevention stopper is supported on an end portion of the first tray surface in the paper discharge direction so as to be turnable up and down, wherein, when the drop-off prevention stopper is arranged at the second position on the first tray surface, one surface of the drop-off prevention stopper forms a second sloping part that inclines upward in the paper discharge direction and more steeply than the first tray surface, and wherein, when the drop-off prevention stopper is arranged at the first position by being turned in such a direction as to separate from the first tray surface, another surface of the drop-off prevention stopper forms a front wall that supports the leading end of the paper loaded in a manner protruding from the paper loading portion.

5. The paper discharge tray of claim 4, wherein a top of the drop-off prevention stopper arranged at the second position is located on a plane that passes through a top of the guide member and also is substantially parallel to the first tray surface.

6. The paper discharge tray of claim 1, wherein an uppermost part of the first sloping part is located on a plane extended from the second tray surface in the paper discharge direction.

7. The paper discharge tray of claim 6, wherein there is formed, on a more downstream side of the first tray surface in the paper discharge direction than the guide member, a drop-off prevention stopper that is selectively arranged at a first position or a second position, the first position supporting a leading end of paper loaded in a manner protruding from the paper loading portion so as to prevent the paper from dropping off, the second position lifting a leading end of paper stored on the paper loading portion beyond the guide member so as to permit easy alignment of the paper by the rear wall.

8. The paper discharge tray of claim 7, wherein the drop-off prevention stopper is supported on an end portion of the first tray surface in the paper discharge direction so as to be turnable up and down, wherein, when the drop-off prevention stopper is arranged at the second position on the first tray surface, one surface of the drop-off prevention stopper forms a second sloping part that inclines upward in the paper discharge direction and more steeply than the first tray surface, and wherein, when the drop-off prevention stopper is arranged at the first position by being turned in such a direction as to separate from the first tray surface, another surface of the drop-off prevention stopper forms a front wall that supports the leading end of the paper loaded in a manner protruding from the paper loading portion.

9. The paper discharge tray of claim 8, wherein a top of the drop-off prevention stopper arranged at the second position is located on a plane that passes through a top of the guide member and also is substantially parallel to the first tray surface.

10. The paper discharge tray of claim 1, wherein a dimension of the guide member in a width direction orthogonal to the paper discharge direction is four times larger than an average thickness of the paper loading portion.

11. The paper discharge tray of claim 1, wherein there is formed, on a more downstream side of the first tray surface in the paper discharge direction than the guide member, a drop-off prevention stopper that is selectively arranged at a first position or a second position, the first position supporting a leading end of paper loaded in a manner protruding from the paper loading portion so as to prevent the paper from dropping off, the second position lifting a leading end of paper stored on the paper loading portion beyond the guide member so as to permit easy alignment of the paper by the rear wall.

12. The paper discharge tray of claim 11, wherein the drop-off prevention stopper is supported on an end portion of the first tray surface in the paper discharge direction so as to be turnable up and down, wherein, when the drop-off prevention stopper is arranged at the second position on the first tray surface, one surface of the drop-off prevention stopper forms a second sloping part that inclines upward in the paper discharge direction and more steeply than the first tray surface, and wherein, when the drop-off prevention stopper is arranged at the first position by being turned in such a direction as to separate from the first tray surface, another surface of the drop-off prevention stopper forms a front wall that supports the leading end of the paper loaded in a manner protruding from the paper loading portion.

13. The paper discharge tray of claim 12, wherein a top of the drop-off prevention stopper arranged at the second position is located on a plane that passes through a top of the guide member and also is substantially parallel to the first tray surface.

14. The paper discharge tray of claim 1, wherein there is formed, on a more downstream side of the first tray surface in the paper discharge direction than the guide member, a drop-off prevention stopper that is selectively arranged at a first position or a second position, the first position supporting a leading end of paper loaded in a manner protruding from the paper loading portion so as to prevent the paper from dropping off, the second position lifting a leading end of paper stored on the paper loading portion beyond the guide member so as to permit easy alignment of the paper by the rear wall.

15. The paper discharge tray of claim 14, wherein the drop-off prevention stopper is supported on an end portion of the first tray surface in the paper discharge direction so as to be turnable up and down, wherein, when the drop-off prevention stopper is arranged at the second position on the first tray surface, one surface of the drop-off prevention stopper forms a second sloping part that inclines upward in the paper discharge direction and more steeply than the first tray surface, and wherein, when the drop-off prevention stopper is arranged at the first position by being turned in such a direction as to separate from the first tray surface, another surface of the drop-off prevention stopper forms a front wall that supports the leading end of the paper loaded in a manner protruding from the paper loading portion.

16. The paper discharge tray of claim 15, wherein a top of the drop-off prevention stopper arranged at the second position is located on a plane that passes through a top of the guide member and also is substantially parallel to the first tray surface.

17. A paper discharge tray comprising:

a first tray surface that receives a substantially front portion of paper discharged;

a second tray surface that receives a substantially rear portion of paper discharged;

a paper loading portion provided in a bent form by arranging the first and second tray surfaces so that both the first and second tray surfaces incline upward in a paper discharge direction with the second tray surface steeper than the first tray surface, wherein paper discharged is loaded along the bent form; and a rear wall that supports a trailing end of paper loaded on the paper loading portion, wherein there is provided on the first tray surface and between a bending portion of the first and second tray surfaces and an end portion of the first tray surface, at least one guide member having a first sloping part that inclines upward in the paper discharge direction with respect to the first tray surface and inclines more steeply than the second tray surface, and wherein the guide member is movable in the paper discharge direction with respect to the first tray surface.

* * * * *